US008567761B2

(12) United States Patent
De Jong et al.

(10) Patent No.: US 8,567,761 B2
(45) Date of Patent: Oct. 29, 2013

(54) SYSTEM WITH POSITION-DETERMINATION FOR LIFTING COLUMNS, AND METHOD THEREFOR

(75) Inventors: Jurjen Jan De Jong, Buitenpost (NL); Lambert Hendrikus Wanschers, Vaassen (NL)

(73) Assignee: Stertil B.V., Kootstertille (NL)

( * ) Notice: Subject to any disclaimer, the term of this patent is extended or adjusted under 35 U.S.C. 154(b) by 534 days.

(21) Appl. No.: 12/864,784

(22) PCT Filed: Jan. 30, 2009

(86) PCT No.: PCT/NL2009/000018

§ 371 (c)(1),
(2), (4) Date: Oct. 27, 2010

(87) PCT Pub. No.: WO2009/099322

PCT Pub. Date: Aug. 13, 2009

(65) Prior Publication Data

US 2011/0037041 A1 Feb. 17, 2011

(30) Foreign Application Priority Data

Feb. 5, 2008 (NL) ..... 1034999

(51) Int. Cl.
*B66F 3/46* (2006.01)

(52) U.S. Cl.
USPC ..... 254/89 R; 254/2 B; 254/134

(58) Field of Classification Search
USPC ..... 254/2 B, 9 B, 10 B, 6 B, 133 R, 134
See application file for complete search history.

(56) References Cited

U.S. PATENT DOCUMENTS

| | | | | |
|---|---|---|---|---|
| 5,484,134 | A * | 1/1996 | Francis | 254/2 B |
| 6,193,219 | B1 * | 2/2001 | Belley et al. | 254/89 H |
| 6,279,685 | B1 * | 8/2001 | Kogan et al. | 187/208 |
| 6,634,461 | B1 * | 10/2003 | Baker | 187/247 |
| 7,014,012 | B2 * | 3/2006 | Baker | 187/247 |
| 7,219,770 | B2 * | 5/2007 | Baker | 187/247 |
| 7,500,816 | B2 * | 3/2009 | Berends et al. | 414/458 |
| 8,256,577 | B2 * | 9/2012 | Kritzer | 187/215 |
| 2011/0037041 | A1 * | 2/2011 | DeJong et al. | 254/89 R |

FOREIGN PATENT DOCUMENTS

| | | | |
|---|---|---|---|
| GB | 2082795 | A | 3/1982 |
| GB | 2310519 | A | 8/1997 |
| WO | 9830488 | A1 | 7/1998 |
| WO | 2004024612 | A1 | 3/2004 |

* cited by examiner

*Primary Examiner* — Lee D Wilson
(74) *Attorney, Agent, or Firm* — The Webb Law Firm

(57) ABSTRACT

A system and method for lifting and lowering an object such as a vehicle, comprising: at least two lifting columns; communication means for communication with the at least two lifting columns; position-determining means for carrying out a position determination for each of the at least two lifting columns; selection means for selecting at least one of the lifting columns on the basis of the position determinations; and at least one control unit co-acting with the communication means during use for the purpose of controlling the lifting columns selected with the selection means.

14 Claims, 3 Drawing Sheets

SYSTEM WITH POSITION-DETERMINATION FOR LIFTING COLUMNS, AND METHOD THEREFOR

BACKGROUND OF THE INVENTION

1. Field of the Invention

The present invention relates to a system for lifting and lowering an object such as a vehicle. The system provides position-determination for the lifting columns.

2. Prior Art

The systems known in practice, which make use of lifting columns for lifting and lowering of a vehicle, usually make use of lifting columns at a fixed position. In such a system the lifting columns co-act in a fixed configuration and can be controlled from one lifting column or another central point. Such a system is less flexible and is unsuitable for adjusting for instance a number of lifting columns to the type of vehicle which has to be lifted and lowered. Such vehicles are for instance a car, a van and trucks with different wheel bases and provided with two or more axles.

Other known systems make use of mobile lifting columns. The flexibility of such a system is hereby increased, since the number and the position of the lifting columns can be adjusted to the requirement, such as for instance the type of vehicle. Such a system is described in NL 1021448. In this system the required lifting columns are selected by a user by setting this requirement at each lifting column individually. This means that a user must move physically through the space in order to select the lifting columns to be used. During this circuit the user must identify the selected lifting columns in this system by means of an identification card which is placed in each selected lifting column. The control hereby knows which lifting column has been selected and how communication therewith can take place. The flexibility obtained with this system is therefore accompanied by additional operations for a user.

SUMMARY OF THE INVENTION

The present invention has for its object to provide a system for lifting and lowering of an object, such as a vehicle, with which the flexibility of known systems is further increased.

This object is achieved with the system according to the invention, comprising:

- at least two lifting columns;
- communication means for communication with the at least two lifting columns;
- position-determining means for carrying out a position determination for each of the at least two lifting columns;
- selection means for selecting at least one of the lifting columns on the basis of the position determinations; and
- at least one control unit co-acting with the communication means during use for the purpose of controlling the lifting columns selected with the selection means.

The system has at least two lifting columns, although the system can for instance also have four, six or eight lifting columns or a multiple thereof. The number of columns is in practice usually an even number, i.e. twice the number of axles of a vehicle for lifting. By means of the communication means it is possible to communicate with each of the selected lifting columns from the control unit. The selection of the lifting columns takes place on the basis of the position determination following from the position-determining means.

Because the position of an individual lifting column is known from the position-determining means, a user can select the required lifting columns, which are for instance already situated closest to the required position, in simple manner from the control unit. This selection can optionally also be performed automatically by the control unit, for instance depending on the type of vehicle. The user walking through the space along the individual lifting columns is hereby unnecessary. After the selection on the basis of the position of the lifting columns the user can control each lifting column from the control unit. For this purpose each lifting column is identified in unique manner such that the control unit can send commands to all selected lifting columns as well as to one or more individual lifting columns. Such an identification can be set permanently for each individual lifting column. This can take place once-only, although it can also take place after each startup of the system. Use can for instance be made for this purpose of a software setting or of a more physical setting, such as for instance with a thumb wheel switch or an identification card. It is also possible to further identify a lifting column from the central control unit after the position determination, for instance by entering the user. If desired, such an identification can be linked to an individual user such that it is for instance always visible which lifting column is being used at that moment by which user/mechanic. The control unit can be provided centrally on a lifting column or decentrally on a plurality of lifting columns. In an alternative embodiment the unit can be provided at a central point in the space, from where the control must be operated. An additional advantage of the system according to the invention is that, after the lowered vehicle has been removed, the selection can be maintained for a subsequent vehicle. In known mobile systems this selection is aborted, for instance by an end switch on the travel mechanism of the lifting column. This switch aborts the selection after a displacement of the column.

In a preferred embodiment according to the present invention the system comprises identification means co-acting with the control unit for identifying at least each selected lifting column on the basis of the position determinations.

The lifting columns can be identified in unique manner by performing the identification of particularly the selected lifting columns on the basis of the positions determined using the position-determining means. It is preferably not necessary for users themselves to identify the lifting columns. These identifications are preferably carried out in automatic manner by the control unit. A user-friendly system is obtained by linking the identification to the position of the lifting column. In addition, it is possible in this way to easily prevent a selected lifting column being used in a different set of lifting columns. This latter can for instance occur if a plurality of sets of lifting columns are placed in the same space to enable work to be done simultaneously on a plurality of vehicles, for instance by a number of mechanics. The safety of such a system according to the invention is hereby increased considerably. It is also possible to display the current positions of selected and optionally non-selected lifting columns on for instance a screen. This screen can form part of the control unit, but can also be placed separately in a space, independently of the control unit. In addition to the positions and selections, such a screen can for instance also display information about the user, such as which mechanic. This further increases the safety and the overall control of the system. The position-determining means can for instance make use of GPS technology for the purpose of thereby determining the position of a lifting column in the space. It is for instance also possible to make use of infrared signals and/or RF signals. These technologies can optionally be applied in combination in the system according to the invention.

In an advantageous preferred embodiment according to the present invention the communication means comprise wireless communication means.

The use of wireless communication means enables optimal utilization of the flexibility of mobile lifting columns. Per se known wireless communication means are usually based on the use of electromagnetic radiation, such as Bluetooth and WiFi. However, the system preferably makes use of transmission in an ultra wide band, so-called Ultra Wideband (UWB). Data for transmission is here transmitted in packets distributed over a wide frequency band. It is hereby possible to transmit such packets in parallel. This UWB technology usually makes use of short pulses to transmit the data. A definition of UWB employed in practice identifies this technology with radio signals having a bandwidth greater than the smallest value of 500 MHz, or 20% of the centre frequency. UWB can for instance be used in the frequency domain of 3.1-10.6 GHz. At a relatively low power the use of UWB technology is possible in a range up to several tens of meters. This already suffices for many applications of the system according to the invention. If desired, the range can be increased by using a higher power. A further advantage of the use of UWB technology is that these signals are disrupted less by obstacles, dividing walls etc. than other wireless networks such as WiFi and Bluetooth.

In a preferred embodiment according to the present invention the position-determining means comprise at least one transmitter/receiver provided on each of the at least two lifting columns.

By providing each lifting column with at least one transmitter/receiver the location of such a lifting column in the space can hereby also be determined. By using UWB technology here, obstacles cause considerably less disruption to an adequate determination of the position compared to other technologies. The direction and/or orientation of the lifting column can for instance be determined with an electronic compass, such as for instance a so-called Hall effect sensor. The position-determining means preferably comprise at least a second transmitter/receiver provided on each of the at least two lifting columns. The position of a column can be determined by carrying out a so-called triangulation measurement. Both the transmitters/receivers on each column here send a signal to a receiver of another column. The receiver then sends a signal back. The time required for the signal to bridge the distance is a measure for this distance. The positions of the transmitters/receivers can be determined by determining the necessary distances in this manner. The use of UWB technology limits disruption from erroneous distance measurements resulting from reflections of the signal. Positioning both the transmitters/receivers in fixed manner on a lifting column can avoid an erroneous, mirrored position of the lifting column being determined. Although such an erroneous position can be easily observed by the user, a correct orientation of the transmitters/receivers on a lifting column can avoid this happening. This increases the safety of the system. It is hereby also possible to determine the correct orientation of the lifting column in the space. It is hereby possible to determine, among other things, whether the prongs of the lifting column, with which an object for lifting is picked up, are pointing in the right direction. For this purpose the transmitters/receivers are for instance placed front left and rear right on the frame of the lifting column. Other positions are also possible for the purpose of determining the orientation of the column in the space. The system according to the invention preferably comprises at least one transmitter/receiver, placed at a position which is known in use, for determining the absolute position of the at least two lifting columns. By relating the relative positions, determined using the transmitters/receivers provided on the lifting columns, to a transmitter/receiver placed at a position in the space which is known in absolute sense, all the lifting columns can also be placed in the space. The overall control of the system and, thereby the safety, is hereby further increased. This reduces the risk, among others, of a user wanting to utilize a lifting column already selected by another user.

In an advantageous preferred embodiment according to the present invention the system comprises safety means, wherein the safety means generate a warning signal and/or blocking signal if at least one of the lifting columns is displaced over a distance at least equal to a safe distance.

If a selected lifting column is displaced while the group of selected lifting columns of which this lifting column forms part is still active, a warning signal can be given using the safety means. This warning signal can be activated if the lifting column is displaced over more than a predetermined distance, the safe distance. A usable safe distance for instance lies in the range of 0 to 1 meter. A small displacement by a user may for instance be desirable if a car lift under a vehicle has to be removed for a short period of time. The safe distance can be adapted hereto. It is also possible to generate a warning signal at each displacement, however small it may be. Instead of a warning signal, a blocking signal can also be generated, whereby the use of the whole group of selected lifting columns is blocked in order to prevent unsafe situations. This makes the system even more secure.

In a further preferred embodiment according to the present invention at least one lifting column is configured in the system as master column and at least one lifting column as slave column.

A master column can be used to select the other columns in its group. These other columns then function as slave columns. In this way all the advantages can thus be gained as in a control which distinguishes master columns and slave columns.

In an advantageous preferred embodiment according to the present invention the lifting columns of the system form a plurality of groups and/or sub-groups. Simultaneous inspection, repair or any operation which may be necessary for a plurality of vehicles is hereby possible. For this purpose a plurality of groups can be operated by the system independently of each other. By making use of a sub-group it is possible to give some of the selected lifting columns in a group a different command relative to the other lifting columns in the same group. There is thus the possibility, among others, of two lifting columns forming a lifting unit for jointly moving for instance an axle of a vehicle, wherein the control unit selects and controls the lifting unit on the basis of the position information from the position-determining means. The lifting unit here forms a kind of sub-group within the group of selected lifting columns. If desired, each group of lifting columns can have a master column, or for instance make use of a multi-master system.

In a further advantageous preferred embodiment according to the present invention the system is provided with at least one transmitter/receiver on a prong of at least one of the lifting columns for the purpose of determining the height thereof.

By providing a prong of the lifting column, with which a vehicle is engaged and lifted, with a transmitter/receiver it is possible to not only determine the position in the two-dimensional plane, for instance parallel to the surface on which the lifting columns are provided, but to also determine the position in a three-dimensional space, such as for instance for the height of the prongs. If one of the selected lifting columns has a transmitter/receiver placed on a prong, the height of all prongs of the lifting columns can be controlled, assuming synchronous operation of the selected lifting columns. This information can be fed back to the control unit, whereby an additional control is possible. This increases the safety of the system. If a plurality of, and optionally all, prongs of the selected lifting columns are provided with transmitters/receivers, it is possible to carry out, on the basis of this information, corrections for mutual height differences. This further enhances the accuracy of the system.

The invention further relates to a method for lifting and lowering an object, such as a vehicle, with a system according to the present invention. Such a method provides the same effects and advantages as those referred to in respect of the system.

BRIEF DESCRIPTION OF THE DRAWINGS

Further advantages, features and details of the invention are elucidated on the basis of preferred embodiments thereof, wherein reference is made to the accompanying drawings, in which.

DETAILED DESCRIPTION OF THE PREFERRED EMBODIMENTS

Figure 1:
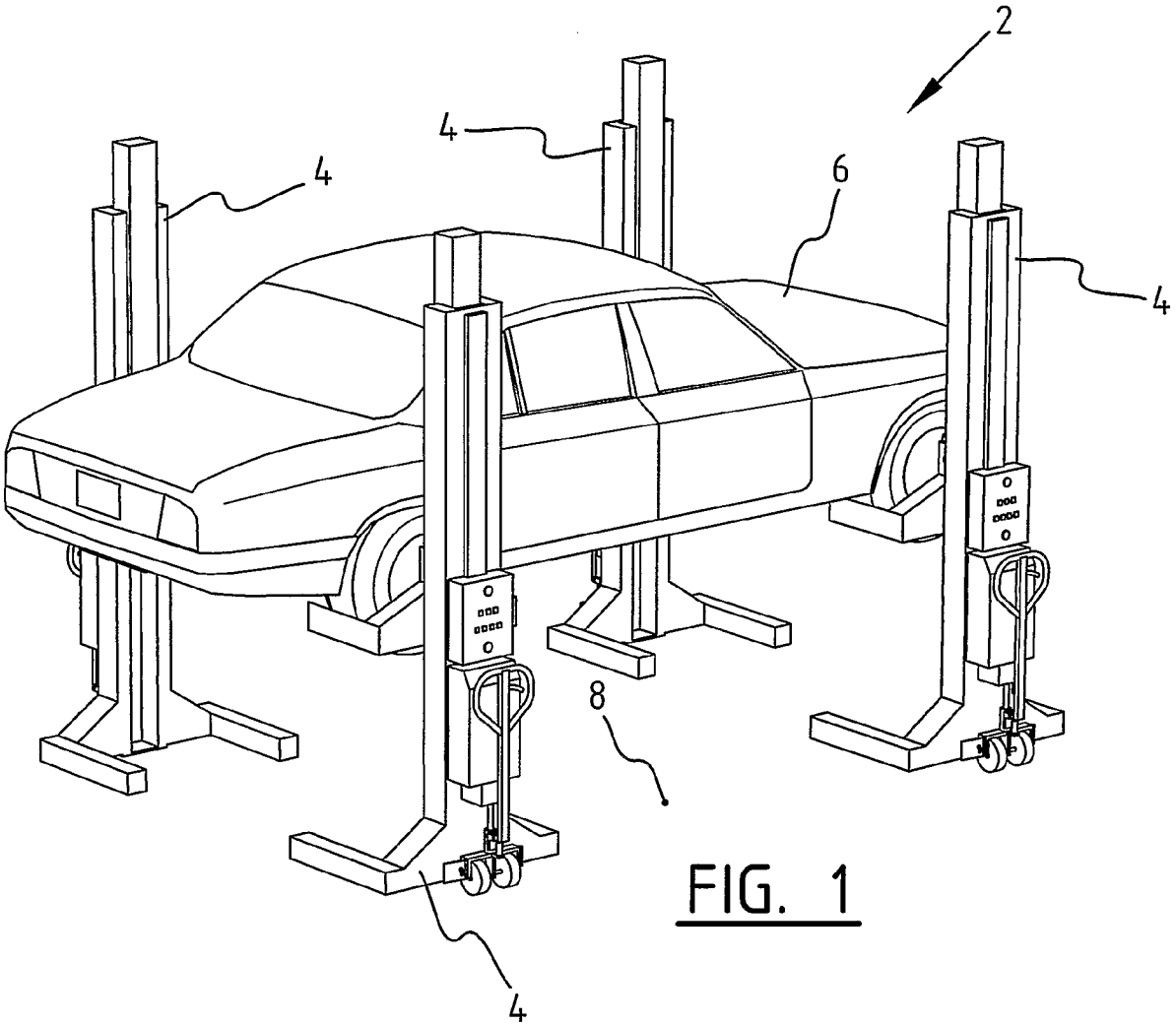
FIG. 1 shows a view of a vehicle lifted by a system according to the invention.

A lifting system 2 (FIG. 1) is assembled from four lifting columns 4. Lifting columns 4 can be connected to each other radiographically or via cables for the exchange of control signals. Lifting system 2 serves to lift a vehicle 6 and re-place it on the ground 8. The lifting system thus has an ascent mode and a descent mode in which lifting columns 4 must run as synchronously as possible.

Figure 2:
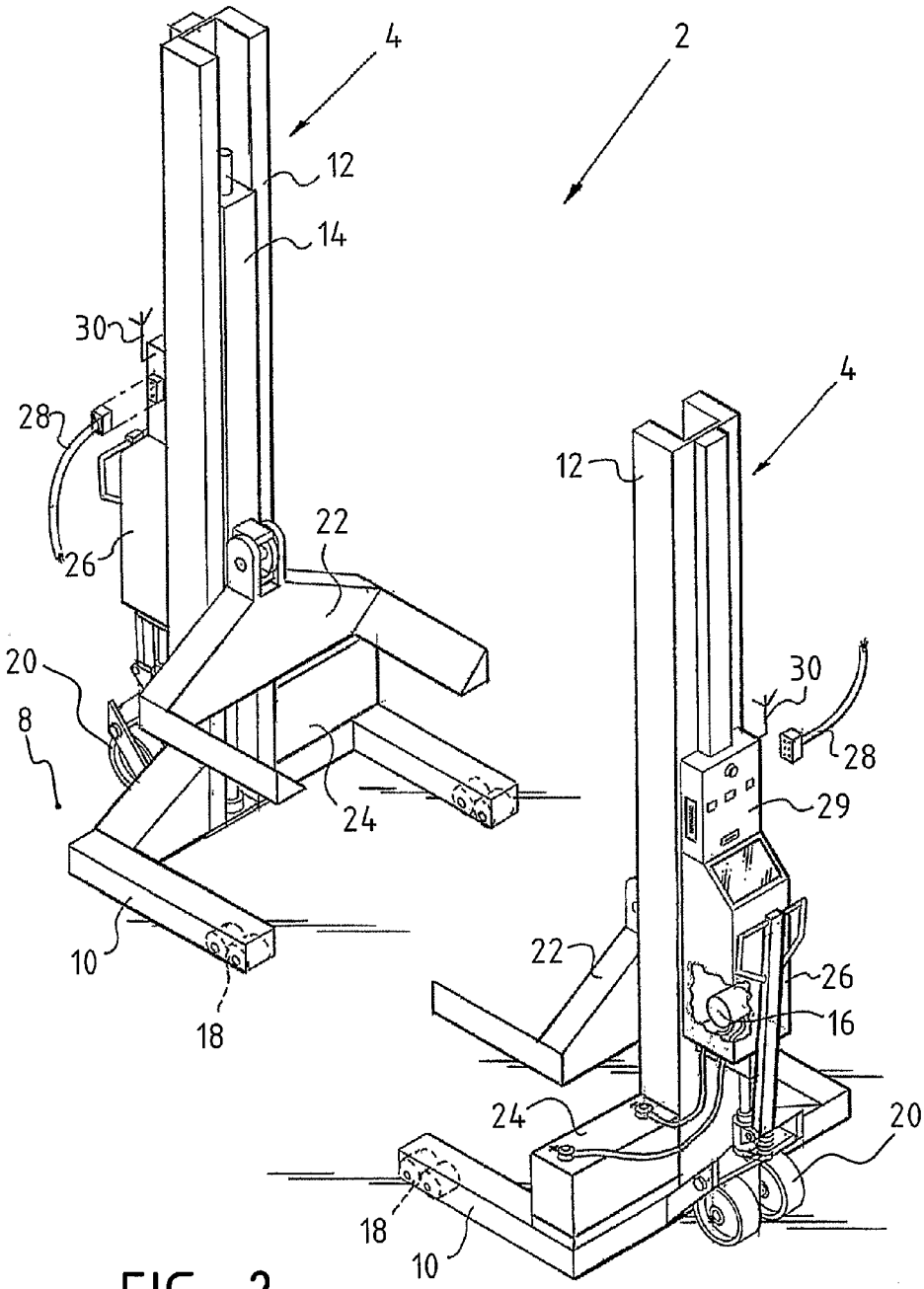
FIG. 2 shows a view of two lifting columns according to the invention.

Each of the lifting columns 4 (FIG. 2) is provided with a foot 10 which can be placed on ground 8, and a mast part 12, wherein a carriage 14 is movable up and downward along mast part 12 under the influence of a drive in the form of a motor 16. Foot 10 and mast part 12 thus form a kind of frame which can travel over rollers 18 and wheels 20. Wheels 20 can be raised along the frame, whereby the foot comes to lie on the ground and there is no danger of the lifting column 4 being able to move away while it is bearing a load. Arranged on carriage 14 is a carrier 22 which is designed to engage for instance a wheel of a vehicle (not shown). Motor 16, in particular an electric motor, is provided with electric power by a battery 24. Battery 24 is a source of energy not only for electric motor 16, but also for a control (not shown) accommodated in a control box 26. The control is usually formed from a microprocessor and a memory co-acting therewith and loaded with a control program. The controls in control boxes 26 control the operation of electric motor 16, and are also mutually connected for this purpose by means of a relatively light cable 28. An additional cable (not shown) can be used to charge batteries 24 when the lifting columns are not in use.

The system shown in the figure as embodiment of the present invention is of the multi-master type. This means that lifting instructions can be entered for both of the lifting columns 4 shown in the figure by inputting the instructions on a control panel 29. The term "multi-master" is furthermore understood to mean that such lifting instructions can be inputted at either of the two lifting columns.

Lifting columns 4 are equipped with an antenna 30 as radiographic communication means for mutual contact. The lifting columns 4 of one sub-group can in any case be in contact with each other for the purpose of executing a lifting operation to be performed by this sub-group on an object for lifting and lowering, in particular a vehicle 6.

Each of the lifting columns 4 is provided with a first transmitter/receiver 30, which can for instance be provided in the vicinity of control panel 29.

When a system 2 is started up, the position is first determined using the transmitters/receivers 30. In the preferred embodiments of system 2 the identification of each of the lifting columns 4 is carried out on the basis of the determined position of these lifting columns. A user can then select the required lifting columns 4 in a group or in a sub-group. This selection can for instance be made by inputting this on a touchscreen, wherein the lifting columns which it is possible to select are displayed on a screen in visual manner. The selected lifting columns can then be controlled from a central control. If a user wishes to configure a new set, the old selections must be cancelled. A delete signal must be sent for this purpose. This prevents the possible co-displacement somewhere of a column which previously formed part of an earlier group of lifting columns from which a part of the new group is formed. For safety reasons each lifting column, during selection, sends a delete signal to the other lifting columns. With such a delete signal it is possible to delete the whole group of selected lifting columns so that a completely new group must be created. It is also possible to remove only that selected lifting column which transmits the delete signal from the set of this group of lifting columns.

Figure 3:
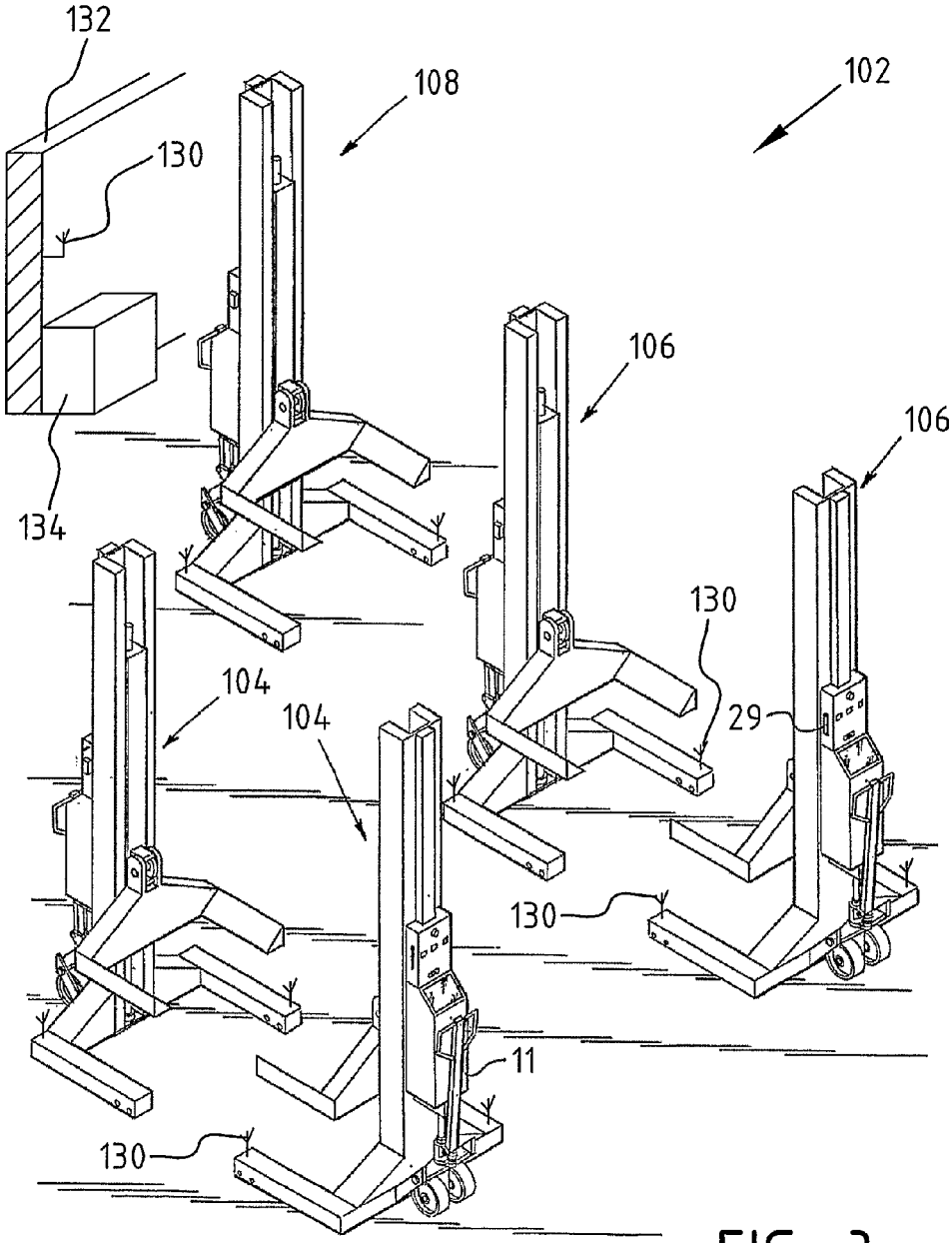
FIG. 3 shows a view of a group of lifting columns according to the invention.

A system 102 (FIG. 3) shows two lifting columns 104, which form a first group of selected lifting columns together with the two lifting columns 106. Within this selected first group the lifting columns 104 form a first sub-group and lifting columns 106 form a second sub-group. Lifting column 108 is not selected for this group and, if desired, can be selected for a second group which can optionally be used by another user. Each of the lifting columns 104, 106, 108 is provided with two antennas or transmitters/receivers 130. One of these antennas 130 is placed on one of the outer ends of the U-shaped base profile which can be placed on the ground. The other antenna 130 is placed at a corner point of the same U-shaped base profile. A further antenna 130 is provided on a side wall 132 in the vicinity of system 102. This antenna 130, attached at a fixed point to side wall 132, also forms part of system 102. By making use of this transmitter/receiver it is possible to also determine the absolute position of lifting columns 104, 106, 108 in the space. Further provided in the space is a central control unit 134 with which the user can operate the various groups and sub-groups of lifting columns 104, 106, 108

The present invention is by no means limited to the above described preferred embodiments. The rights sought are defined in the following claims, within the scope of which many modifications can be envisaged. It is thus possible for instance to define in automatic manner a lifting pair which can function as sub-group, for instance for the dismantling of axles under a vehicle. It is then no longer necessary to manually determine such a pair or to operate it manually.

The invention claimed is:

1. A system for lifting and lowering an object such as a vehicle, comprising:

at least two lifting columns each comprising a carriage for holding the object;

communication means for communication with the at least two lifting columns;

position-determining means for each of the at least two lifting columns for carrying out a spatial position determination for each of the at least two lifting columns positioned relative to each other with respect to actual spatial positioning within a communication range;

selection means for selecting at least one of the lifting columns on the basis of the spatial position determination made by the position-determining means; and at least one control unit co-acting with the communication means during use for the purpose of controlling the carriage of the lifting columns selected with the selection means.

2. The system as claimed in claim 1, further comprising identification means co-acting with the control unit for identifying a selected lifting column on the basis of the position determinations.

3. The system as claimed in claim 1, wherein the communication means comprise wireless communication means.

4. The system as claimed in claim 3, wherein the communication means send data in an ultra wide frequency band.

5. The system as claimed in claim 1, wherein the position-determining means comprise at least one transmitter/receiver provided on each of the at least two lifting columns.

6. The system as claimed in claim 5, wherein the position-determining means comprise at least a second transmitter/receiver provided on each of the at least two lifting columns for the purpose of determining the orientation of the lifting column.

7. The system as claimed in claim 5, further comprising at least one transmitter/receiver, placed at a position which is known in use, among other purposes for also determining the absolute position of the at least two lifting columns.

8. The system as claimed in claim 1, further comprising safety means which generate a warning signal or blocking signal if at least one of the lifting columns is displaced over a distance at least equal to a safe distance.

9. The system as claimed in claim 1, wherein at least one lifting column is configured as a master column and at least one lifting column is configured as a slave column.

10. The system as claimed in claim 1, wherein the lifting columns form a plurality of groups and/or sub-groups.

11. The system as claimed in claim 10, wherein at least two lifting columns form a lifting unit for jointly moving at least a part of a vehicle, and wherein the selection means select the lifting unit on the basis of position information from the position-determining means.

12. The system as claimed in claim 1, further comprising at least one transmitter/receiver provided on a prong of at least one of the lifting columns for the purpose of determining the height thereof.

13. A method for lifting and lowering an object, such as a vehicle, comprising the steps of:

providing a system as claimed in claim 1;

selecting lifting columns in a set on the basis of spatial position information; and controlling the carriage of the selected lifting columns with a control unit.

14. The system as claimed in claim 1, further comprising safety means which generate a warning signal and blocking signal if at least one of the lifting columns is displaced over a distance at least equal to a safe distance.

* * * * *

UNITED STATES PATENT AND TRADEMARK OFFICE

CERTIFICATE OF CORRECTION

PATENT NO. : 8,567,761 B2
APPLICATION NO. : 12/864784
DATED : October 29, 2013
INVENTOR(S) : De Jong et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 617 days.

Signed and Sealed this
Fifteenth Day of September, 2015

Michelle K. Lee

Michelle K. Lee
*Director of the United States Patent and Trademark Office*